US005749242A

United States Patent [19]

Mowery

[11] Patent Number: 5,749,242

[45] Date of Patent: May 12, 1998

[54] EVAPORATOR FOR AN ICE MAKING MACHINE

[76] Inventor: Timothy W. Mowery, 4723 Lois La., Wichita Falls, Tex. 76306

[21] Appl. No.: 822,495

[22] Filed: Mar. 24, 1997

[51] Int. Cl.[6] ..... F25C 1/12

[52] U.S. Cl. ..... 62/347; 62/519; 165/142

[58] Field of Search ..... 62/74, 347, 348, 62/518, 519, 524, 352; 165/142

[56] References Cited

U.S. PATENT DOCUMENTS

| | | | |
|---|---|---|---|
| 2,672,032 | 3/1954 | Towse | 62/126 |
| 2,959,027 | 11/1960 | Ewing | 62/160 |
| 3,053,058 | 9/1962 | Kocher | 62/233 |
| 3,181,309 | 5/1965 | Wilbushewich | 62/352 |
| 3,320,768 | 5/1967 | Barrett | 62/352 |
| 3,435,633 | 4/1969 | Dixon | 62/352 |
| 3,526,100 | 9/1970 | Briel | 62/136 |
| 4,094,168 | 6/1978 | Hamner et al. | 62/347 |
| 4,671,351 | 6/1987 | Rappe | 165/142 |
| 4,694,656 | 9/1987 | Lane et al. | 62/74 |
| 5,031,409 | 7/1991 | Johnson | 62/352 |
| 5,099,656 | 3/1992 | Martineau | 62/347 |
| 5,182,925 | 2/1993 | Alvarez et al. | 62/347 |
| 5,555,734 | 9/1996 | Welch et al. | 62/348 |
| 5,606,869 | 3/1997 | Joo | 62/347 |

FOREIGN PATENT DOCUMENTS 185351 12/1966 U.S.S.R. .

*Primary Examiner*—William E. Tapolcal
*Attorney, Agent, or Firm*—Stephen R. Greiner

[57] ABSTRACT

An evaporator having a tortuous refrigerant flow path for use in an ice making machine. The evaporator includes a first tubular member having a closed bottom end and a closed top end with a first aperture. A second tubular member is concentrically positioned within the first tubular member. The second tubular member has a closed bottom end with a second aperture spaced from the closed bottom end of the first tubular member and an open top end spaced from the closed top end of the first tubular member. A helical baffle plate is coiled around second tubular member. A third tubular member is concentrically positioned within the second tubular member. The third tubular member has an open bottom end spaced from the closed bottom end of the second tubular member and a top end extending through the first aperture in the first tubular member. A fourth tubular member is concentrically positioned within the third tubular member and extends through the second aperture in the second tubular member. The fourth tubular member has an open bottom end located between the closed bottom end of the second tubular member and the closed bottom end of the first tubular member.

18 Claims, 3 Drawing Sheets

EVAPORATOR FOR AN ICE MAKING MACHINE

FIELD OF THE INVENTION

The present invention relates generally to refrigeration producers and, in particular, to an improved evaporator or heat exchanger.

BACKGROUND OF THE INVENTION

Refrigeration systems adapted to artificially produce ice by cycling through alternative freezing and harvesting phases have long been in commercial use. These systems typically include: a compressor, a condenser, and an evaporator having a closed refrigerant chamber with an exterior, ice-forming surface to which liquid water may be applied and frozen. Unfortunately, these systems have been objectionable because their refrigerant chambers absorbed heat inefficiently thereby resulting in wasted energy and unnecessarily limited ice production capacity.

SUMMARY OF THE INVENTION

In light of the problems associated with the known refrigerant evaporators for ice making machines, it is a principal object of the present invention to provide an evaporator capable of absorbing heat at a relatively higher rate thereby lowering energy consumption during use and raising ice production capabilities. To this end, my improved evaporator features a number of concentrically positioned tubular members which are interconnected for the flow of refrigerant. The refrigerant flow path established by the tubular members is a tortuous one, having multiple switchbacks, which increases the distance and time required for the refrigerant to travel through the evaporator. Thus, relatively more heat is absorbed, and more ice is produced, since cold refrigerant is retained in the evaporator for an extended period of time.

It is another feature of the invention to provide a helical baffle plate between the outer pair of concentrically positioned tubular members. This baffle plate serves primarily to increase the distance and time required for refrigerant to travel past the outer tubular members of the evaporator. Nonetheless, the baffle plate also serves as a heat sink, transferring heat between the outer pair of tubular members, and ensures that refrigerant will flow evenly past all of the ice forming surface of the outermost tubular member to produce ice of even thickness on the outermost tubular member.

So that ice may be produced by the evaporator in the form of discrete "cubes," the evaporator also features a number of external fins positioned around the outermost tubular member which define laterally and longitudinally segregated, open spaces for ice formation. To reduce the likelihood of ice "bridging" over the ends of the longitudinal fins and distorting the desired, regular form of the "cubes," an insulative cover is secured to the outer edge of each longitudinal fin.

My evaporator additionally features a pair of insulative water flow assemblies which efficiently transport liquid water to and from the outermost tubular member and external fins as well as limit the formation of ice to predetermined locations. The design of the flow assemblies also permits several evaporators to be connected in series to a single source of water if desired.

It is an object of the invention to provide improved elements and arrangements thereof in an evaporator for the purposes described which is lightweight and uncomplicated in construction, inexpensive in manufacture, as well as dependable and fully effective in use.

The foregoing and other objects, features and advantages of the present invention will become readily apparent upon further review of the following detailed description of the preferred embodiment as illustrated in the accompanying drawings.

BRIEF DESCRIPTION OF THE DRAWINGS

The present invention may be more readily described with reference to the accompanying drawings, in which.

Similar reference characters denote corresponding features consistently throughout the accompanying drawings.

DETAILED DESCRIPTION OF THE PREFERRED EMBODIMENT

Figure 1:
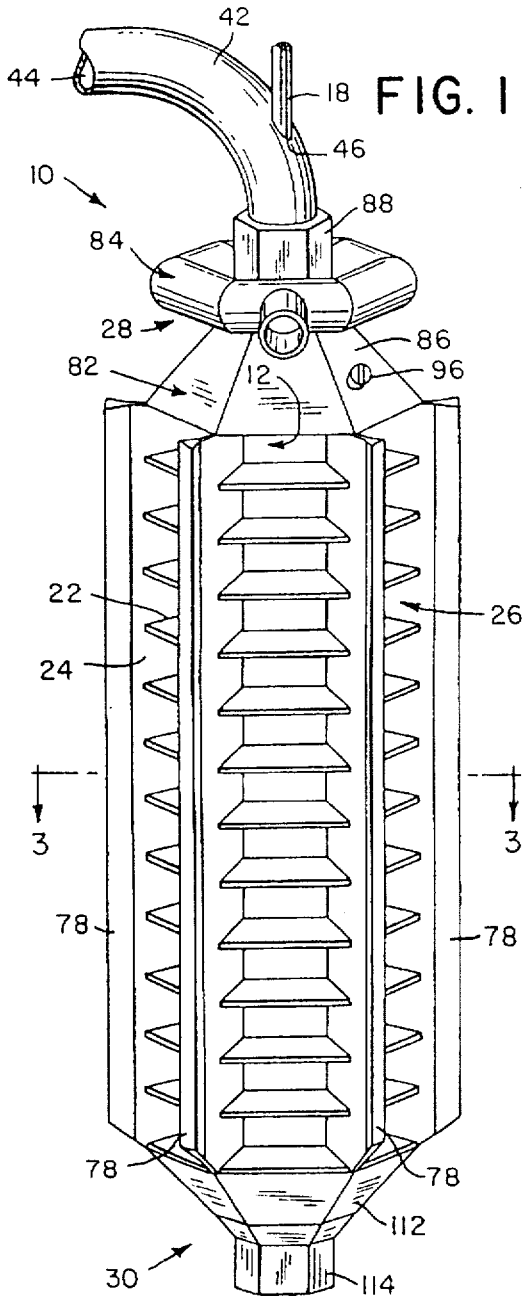
FIG. 1 is a perspective view of an evaporator for an ice making machine in accordance with the present invention.

Referring now to the FIGS., an evaporator in accordance with the present invention is shown at 10. The evaporator 10 includes an upright body 12 formed of metal having a high heat conductivity. The body 12 is provided with an outer tubular member 14 and inner concentrically-positioned tubular members 16, 18 and 20 which define a tortuous flow path for a refrigerant circulated through the body 12. A number of metallic fins 22 and 24 surround the outer tubular member 14 to provide segregated, open spaces 26 within which ice may form and accumulate. To deliver a steady stream of liquid water to the spaces 26 for freezing, water flow assemblies 28 and 30 are secured to the top and bottom of the body 12.

The outer tubular member 14 is preferably hexagonal in cross section to provide planar, exterior surfaces for ice formation. The top and bottom ends of the outer tubular member 14 are capped by hexagonal plates 32 and 34. A threaded rod 36 is secured at one end to the bottom plate 34 and extends downwardly therefrom. The top plate 32, on the other hand, is provided with a central aperture 38 about the periphery of which the discharge tubular member 16 is secured in a sealed manner.

From the top plate 32, the discharge tubular member 16 extends downwardly into the outer tubular member 14 and terminates at a free and open end 40 adjacent to, but spaced from, the bottom plate 34. The discharge tubular member 16 also extends upwardly from the top plate 32 to an integral arcuate portion 42 having an end 44 positioned laterally of the aperture 38. Vertically aligned with the center of the aperture 38, a relatively smaller aperture 46 is provided in the arcuate portion 42 of the discharge tubular member 16.

Figure 2:
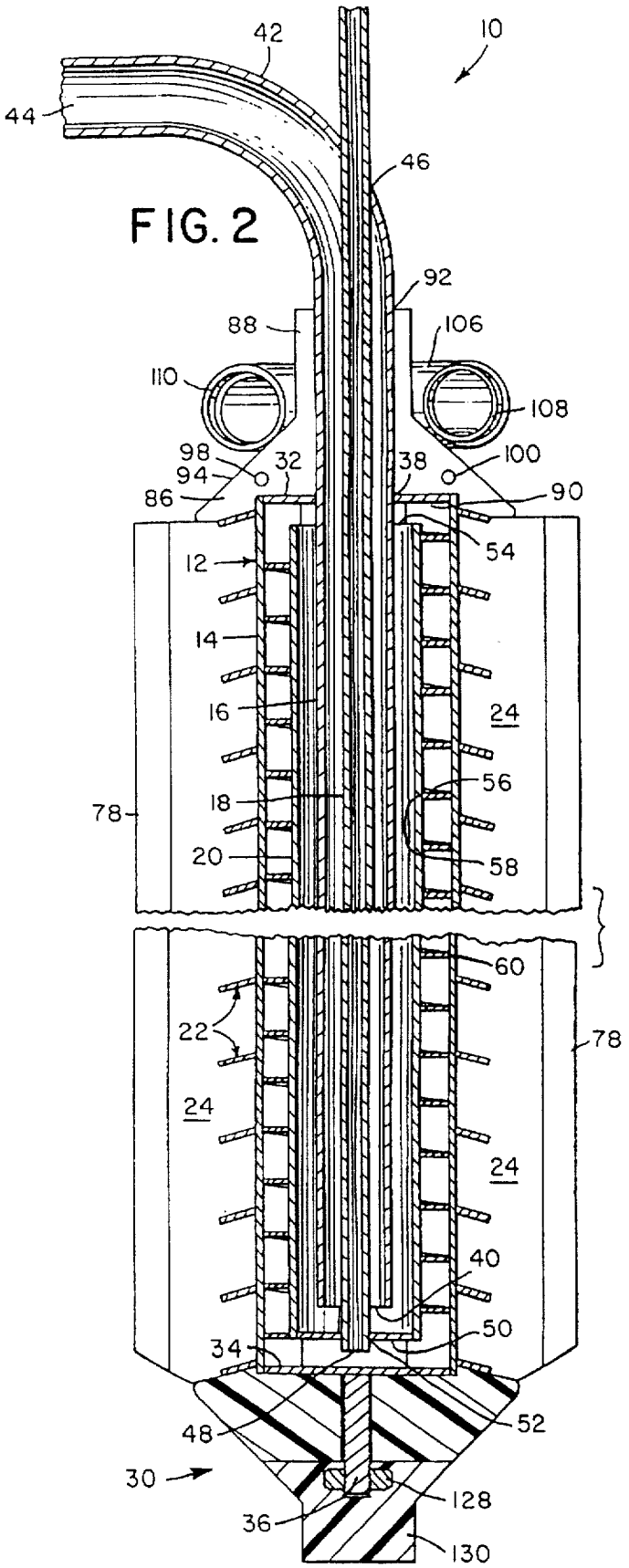
FIG. 2 is a side elevational view of the evaporator with portions broken away to reveal the interior details thereof.

Secured in the aperture 46 is the inlet tubular member 18. The inlet tubular member 18 extends downwardly through the discharge tubular member 16 to terminate at a free and open end 48. As shown in FIG. 2., the open end 48 is spaced between the open end 40 of the discharge tubular member 16 and the bottom plate 34.

Between the open end 40 of the discharge tubular member 16 and the bottom plate 34, a support plate 50 extends radially outward from the inlet tubular member 18. The support plate 50 comprises a flat disk having an outer diameter greater than that of the discharge tubular member 16 yet smaller than the distance across the flat portions of the outer tubular member 14. A central aperture 52 in the support plate 50 snugly receives the inlet tubular member 18 and about this aperture 52 the inlet tubular member 18 and the support plate 50 are secured together.

The intermediate tubular member 20 is secured at its bottom end to the periphery of the support plate 50. The intermediate tubular member 20 extends upwardly from the support plate 50 and concentrically about the discharge tubular member 16. The upper free and open end 54 of the intermediate tubular member 20 is adjacent to, but spaced from, the top plate 32.

A helical baffle plate 56 spirals around the intermediate tubular member and bridges the annular space between the outer tubular member 14 and the intermediate tubular member 20. To accommodate the divergent shapes of the outer and intermediate tubular members 14 and 20, the inner edge 58 of the baffle plate 56 has a smoothly curved form whereas the outer edge 60 includes a plurality of substantially linear segments. To maximize its length, the baffle plate 56 has a bottom end 62 positioned adjacent the bottom end of the intermediate tubular member 20 and a top end 64 positioned adjacent the top end of the intermediate tubular member.

Each of the annular fins 22 comprises six trapezoidal segments 66 integrally fastened together so as to define an hexagonal central opening 68 sized to fit snugly around the outer tubular member 14. To improve water and ice runoff, the segments 66 each slope downwardly from the opening 68 at an angle of about fifteen degrees. Radial slots 70 are provided in the annular fins 22 at the junctions between the trapezoidal segments 66 sized to partially receive and support the longitudinal fins 24.

Each of the longitudinal fins 24 is adapted for a "tongue in groove" type of interlock with the radial slots 70 of the annular fins 22. As such, each longitudinal fin 24 includes a plurality of slots 72 spaced along its inner edge which correspond with the spacing of the annular fins 22. The slots 72 are angled at fifteen degrees to match the slope of the trapezoidal segments 66. As shown, the slots 72 also have dimensions sufficient to permit the inner edge of each longitudinal fin 24 to be positioned flush with the outer tubular member 14.

Figure 3:
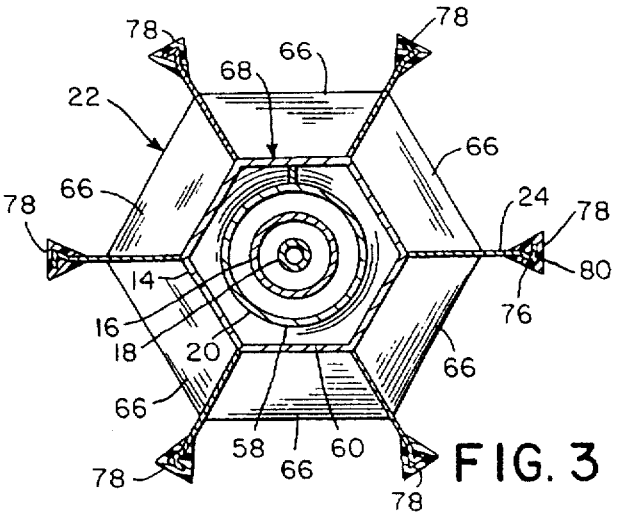
FIG. 3 is a cross-sectional view taken along line 3—3 of FIG. 1.

Referring now to FIG. 3, the outer edge of each longitudinal fin 24 may be seen to be provided with a C-shaped bend 76. Preferably, each C-shaped bend 76 extends from the top of the outer edge to its bottom of each longitudinal fin 24. Each C-shaped bend 76 is formed with conventional sheet metal folding techniques.

An ice limit guide 78, having a longitudinal slot 80 corresponding in shape with the C-shaped bend 76, covers the outer edge of each longitudinal fin 24. To produce ice "cubes" of regular shape, each ice limit guide 78 is formed of an insulative material such as plastic to restrict ice formation to the confined spaces 26 adjacent the outer tubular member 14 and between the fins 22 and 24. The triangular cross-sectional form of the guides 78 offers little frictional resistance to the ice "cubes" when they drop from the spaces 26.

The upper water flow assembly 28 includes a cap 82 formed of an insulative, thermoplastic material, upon which an annular water supply conduit 84 rests. The cap 82 includes pyramidal portion 86 and integral, neck portion 88. The pyramidal portion 86 tapers from a relatively wide bottom to its junction with the upwardly extending and narrowed neck portion 88. A recess 90 is provided in the bottom of the pyramidal portion 86 to snugly receive the top of the upright body 12. A longitudinal aperture 92 extends upwardly from the center of the recess 90 through the pyramidal and neck portions 86 and 88 to accommodate the discharge tubular member 16. For ease of assembly, the cap 82 is preferably constructed from two identical halves 94 which are fastened together by threaded fasteners 96 inserted in bores 98 and 100 located in the pyramidal portion 86 of the cap 82.

The annular water supply conduit 84 encircles the neck portion 88 of the cap 82 and is supported by the pyramidal portion 86 thereof. Water discharge nozzles 102 in the bottom of the water supply conduit 84 are directed downwardly onto the upper surface of the pyramidal portion 86. The nozzles 102 communicate with the interior of the water supply conduit 84 which is connected by means of water supply inlets 104 to a suitable fresh water supply such as a pump outlet (not shown). To permit the conduit 84 to be easily removed for cleaning, etc., it is preferably constructed from two identical halves 106 having snap-fit, male and female socket components 108 and 110 at its opposite ends.

The lower water flow assembly 30 includes a cap 112 and a pyramidal retainer 114 each formed substantially from an insulative, thermoplastic material. The cap 112 includes oppositely tapered upper and lower portions 116 and 118 integrally joined at a common girdle 120 having a cross-sectional configuration substantially similar to that of the annular fins 22. A recess 122 in the upper portion 116 snugly receives the bottom of the upright body 12. The upper portion 116 slopes downwardly from the periphery of the recess 122 at an angle of fifteen degrees so as to fit flush with the lowermost annular fin 22. From the girdle 120, the lower portion 118 tapers to a relatively narrow and flat table 124. A longitudinal aperture 126 extends through the center of the cap 112 from the recess 122 to the table 124 to accommodate the threaded rod 36.

The pyramidal retainer 114, having a nut 128 imbedded with a plastic shell 130, is threadably fastened to the rod 36. At its upper end, the retainer 114 includes a planar abutment surface 132 having an outline conforming with that of the table 124. The sides of the shell 130 taper at the same slope as that of the lower portion 118 of the cap 112 to a narrowed neck portion 134 which may be easily grasped and turned by hand. During use, a trough (not shown) would be positioned beneath the neck portion 134 to catch liquid water dripping from the evaporator 10.

Figure 4:
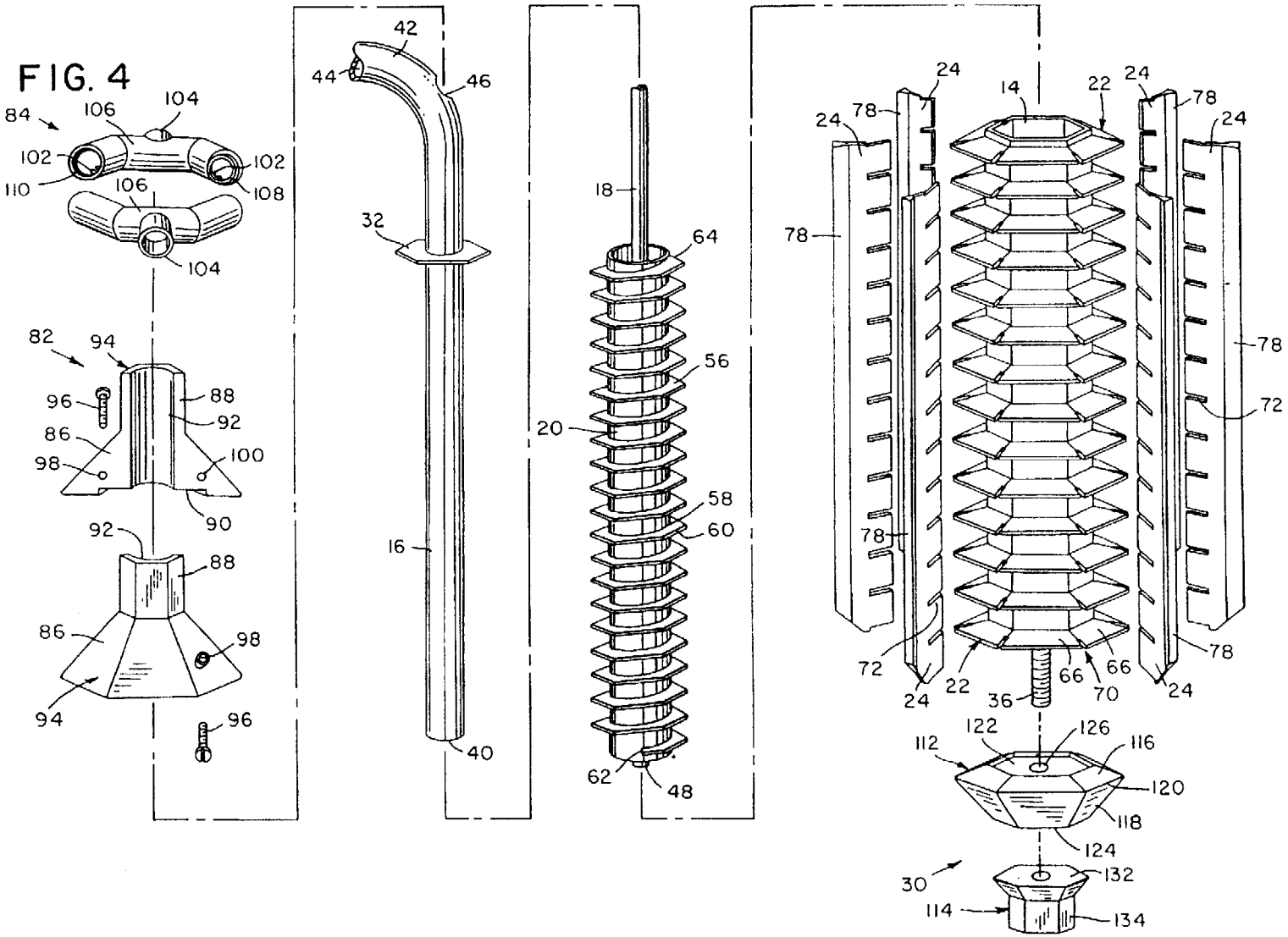
FIG. 4 is an exploded perspective view of the evaporator.

To construct the upright body 12 of the evaporator 10, many of its component parts are first joined together as subassemblies like those illustrated in FIG. 4. The outer tubular member 14, bottom plate 34 and threaded rod 36 are welded together to form a first subassembly. The inlet tubular member 18, support plate 50, intermediate tubular member 20 and helical baffle plate 56 are welded together to form a second subassembly. Likewise, the discharge tubular member 16 and top plate 32 are welded together to form a third subassembly.

After construction of the second subassembly noted hereinabove, the outer edge 60 of the helical baffle plate 56 is trimmed to size using conventional machine tools. It is preferable that the inner edge 58 be initially welded onto the intermediate tubular member 20 so that the outer edge 60 can be shaped for a snug and precise fit within the outer member 14.

Once the subassemblies are formed, they may be joined together. To do this, the upper end of inlet tubular member 18 is first inserted into the lower open end 40 of the discharge tubular member 16 and then drawn from the remote aperture 46. Next, the tubular members 16 and 18 are secured together by welding around the aperture 46. Finally, the now joined, second and third subassemblies are lowered into the outer tubular member 14. By welding the top plate 32 in place within the outer tubular member 14, the upright body 12 is essentially complete. To finish the task, the annular and longitudinal fins 22 and 24 need only be welded in place to the periphery of the outer tubular member 14.

The thermoplastic components of the evaporator 10 are secured to the upright body 12 after all welding has been completed. The water flow assemblies 28 and 30 are attached, respectively, to the top and bottom of the upright body 12 as described hereinabove. Next, the ice limit guides 78 are slid onto the C-shaped bends 76 at the outer edges of the longitudinal fins 24. To prevent water from penetrating into the areas of contact between the plastic and metallic components of the evaporator 10 during use, a conventional silicone sealant is preferably applied to these areas during assembly.

To provide water-freezing temperatures, the evaporator 10 is connected to a conventional refrigeration system including a compressor, condenser and expansion valve from which compressed refrigerant is supplied in a liquid phase through inlet tubular member 18 into the upright body 12. (In view of the fact that refrigeration systems are well known in the art to which the present invention relates, only a cursory description thereof is deemed necessary and will be provided herein.) Since the interior of the body 12 is maintained at a reduced pressure by the action of the compressor, the refrigerant boils and expands in volume as it travels through the inlet tubular member 18. Absorbing heat and causing the outer tubular member 14 to become cold, gaseous refrigerant swirls upwardly through the annulus between the outer tubular member 14 and the intermediate tubular member 20 due to the presence of the helical baffle plate 56.

Upon reaching the open upper end 56 in the intermediate tubular member 20, the gaseous refrigerant reverses course and flows downwardly through the annulus between the intermediate tubular member 20 and the discharge tubular member 16. The refrigerant then enters the open end 40 of the discharge tubular member and proceeds upwardly through the discharge tubular member where it is discharged from end 44. After leaving the discharge tubular member 14 at end 44, the gaseous refrigerant is recompressed, recooled and subsequently recirculated to the inlet tubular member 18.

To produce ice on the exterior of the evaporator 10, a flow of water is delivered to the annular supply conduit 84 through an inlet 104. The water is discharged through nozzles 102 onto the pyramidal portion 86 of cap 82 where such is evenly distributed onto the refrigerated surfaces of the upright body 12 including the outer tubular member 14 and fins 22 and 24. The water delivered to the upright body 12 transfers its heat to the refrigerant being circulated therein and collects as a deposit of ice in the spaces 26 between the fins 22 and 24.

When the ice reaches a predetermined thickness, hot refrigerant discharge gas from the compressor may be caused to enter the evaporator 10. The hot refrigerant gas warms the upright body 12 to the point where adjacent ice surfaces melt slightly. Under the influence of gravity, the ice will slide downwardly from the spaces 26 in the form of "cubes" for collection in a suitable storage bin.

From the foregoing it will be noted that I have devised an evaporator for making ice which is simple and practical and avoids the need for internal valves which are difficult to repair. The evaporator 10 may, of course, be any desired length. Where height is limited, however, multiple evaporators may be connected in parallel to a refrigeration system so that the desired ice output can be obtained from multiple units.

While the invention has been described with a high degree of particularity, it will be appreciated by those skilled in the art that numerous modifications and substitutions may be made thereto. For example, the number of concentrically positioned tubular members may be increased, if desired, to lengthen the refrigerant flow path. Therefore, it is to be understood that the present invention is not limited to the sole embodiment described above, but encompasses any and all embodiments within the scope of the following claims.

I claim:

1. An evaporator for an ice making machine, comprising:

a first tubular member having a closed bottom end and a closed top end with a first aperture therein;

a second tubular member concentrically disposed within said first tubular member, said second tubular member having a closed bottom end, with a second aperture therein, spaced from the closed bottom end of said first tubular member, and said second tubular member also having an open top end, spaced from the closed top end of said first tubular member, thereby connecting said first tubular member with said second tubular member for refrigerant flow;

a third tubular member concentrically disposed within said second tubular member, said third tubular member having an open bottom end, spaced from the closed bottom end of said second tubular member, thereby connecting said second tubular member with said third tubular member for refrigerant flow, and said third tubular member also having a top end extending through said first aperture in said first tubular member; and, a fourth tubular member concentrically disposed within said third tubular member and extending through said second aperture in said second tubular member, said fourth tubular member having an open bottom end located between the closed bottom end of said second tubular member and the closed bottom end of said first tubular member thereby connecting said first tubular member with said fourth tubular member for refrigerant flow.

2. The evaporator according to claim 1 further comprising a helical baffle plate coiled around second tubular member for restricting refrigerant flow in the annular space between said first and second tubular members.

3. The evaporator according to claim 2 wherein said helical baffle plate comprises a strip of heat conductive material having an outer edge contacting said first tubular member and an opposed inner edge contacting said second tubular member whereby heat is transferred through said strip from said first tubular member to said second tubular member.

4. The evaporator according to claim 3 wherein said strip of heat conductive material has a top end located adjacent the open top end of said second tubular member and a bottom end located adjacent the closed bottom end of said second tubular member.

5. The evaporator according to claim 1 further comprising a plurality of external fins positioned around said first tubular member forming laterally and longitudinally segregated open spaces for ice formation.

6. The evaporator according to claim 5 wherein said plurality of external fins comprise:

a plurality of annular fins secured around said first tubular member in a spaced-apart relationship, each of said annular fins having opposed top and bottom surfaces and a central opening, sized to snugly receive said first tubular member, connecting said top and bottom surfaces, and the top surface of each of said annular fins being sloped downwardly from said central opening; and, a plurality of longitudinal fins concentrically positioned around said first tubular member and engaged with the top and bottom surfaces of said annular fins so as to divide such into a plurality of laterally segregated segments, each of said longitudinal fins having an inner edge secured against said first tubular member and an outer edge spaced outwardly from the outer peripheral edge of each of said annular fins relative to said first tubular member.

7. The evaporator according to claim 6 wherein said first tubular member has a polygonal cross section thereby providing said first tubular member with a plurality of planar side walls and wherein said inner edges of said longitudinal fins are secured against said first tubular member along each of the junctions between said planar side walls.

8. The evaporator according to claim 6 further comprising a plurality of insulative covers each being secured to an outer edge of a corresponding one of said longitudinal fins, and each of said insulative covers being formed of a material having a relatively lower heat transfer rate than that of said longitudinal fins.

9. The evaporator according to claim 6 further comprising:

an upper water flow assembly secured atop said first tubular member;

a lower water flow assembly secured beneath said first tubular member; and, said upper and lower water flow assemblies each being formed from an insulative material, said insulative material having a relatively lower heat transfer rate than that of said first tubular member.

10. The evaporator according to claim 9 wherein said upper water flow assembly comprises:

a first cap secured around the top end of said third tubular member, said first cap including a pyramidal lower portion with a recess for receiving the closed top end of said first tubular member and a narrowed neck portion extending upwardly from said pyramidal lower portion; and, an annular conduit positioned around said neck portion of said first cap and supported by said pyramidal portion thereof, said annular conduit including at least one inlet for connection to water source and one outlet opening for distributing water received through said inlet onto said pyramidal lower portion of said first cap and then onto said first tubular member and said external fins.

11. The evaporator according to claim 9 wherein said first tubular member includes:

a threaded rod extending outwardly from the closed bottom end thereof; and, wherein said lower water flow assembly includes:

a second cap fitted over a portion of said threaded rod, said second cap having an upper portion adapted to fit snugly against the bottom surface of the annular fin positioned closest to the closed bottom end of said first tubular member, said second cap also having a lower portion tapering to a planar table surface; and, a cap retainer threadably fastened to the free end of said threaded rod, said cap retainer having, at its top, a planar abutment surface for flush positioning against said planar table surface of said second cap, said planar abutment surface tapering at the same slope as that provided to the lower portion of said second cap to a narrowed neck portion having sides oriented substantially parallel to the longitudinal axis of said evaporator.

12. An evaporator for an ice making machine, said evaporator comprising:

a first tubular member having a closed bottom end and a closed top end with a first aperture therein;

a second tubular member concentrically disposed within said first tubular member, said second tubular member having a closed bottom end, with a second aperture therein, spaced from the closed bottom end of said first tubular member, and said second tubular member also having an open top end, spaced from the closed top end of said first tubular member, which connects said first tubular member with said second tubular member for refrigerant flow;

a third tubular member concentrically disposed within said second tubular member, said third tubular member having an open bottom end, spaced from the closed bottom end of said second tubular member, which connects said second tubular member with said third tubular member for refrigerant flow, and said third tubular member also having a top end extending through said first aperture in said first tubular member;

a fourth tubular member concentrically disposed within said third tubular member and extending through said second aperture in said second tubular member, said fourth tubular member having an open bottom end located between the closed bottom end of said second tubular member and the closed bottom end of said first tubular member which connects said first tubular member with said fourth tubular member for refrigerant flow;

a plurality of external fins positioned around said first tubular member forming laterally and longitudinally segregated open spaces for ice formation; and, means for delivering water onto said first tubular member and external fins.

13. The evaporator according to claim 12 further comprising a helical baffle plate coiled around second tubular member for restricting refrigerant flow in the annular space between said first and second tubular members.

14. The evaporator according to claim 13 wherein said helical baffle plate comprises a strip of heat conductive material having an outer edge contacting said first tubular member and an opposed inner edge contacting said second tubular member whereby heat is transferred through said strip from said first tubular member to said second tubular member.

15. The evaporator according to claim 14 wherein said strip of heat conductive material has a top end located adjacent the open top end of said second tubular member and a bottom end located adjacent the closed bottom end of said second tubular member.

16. An evaporator for an ice making machine, comprising:

a first tubular member having a polygonal cross section so as to provide such with a plurality of planar side walls, said first tubular member also having a closed bottom end and a closed top end with a first aperture therein;

a second tubular member concentrically disposed within said first tubular member, said second tubular member having a closed bottom end, with a second aperture therein, spaced from the closed bottom end of said first tubular member, and said second tubular member also having an open top end, spaced from the closed top end of said first tubular member, which connects said first tubular member with said second tubular member for refrigerant flow;

a third tubular member concentrically disposed within said second tubular member, said third tubular member having an open bottom end, spaced from the closed bottom end of said second tubular member, which connects said second tubular member with said third tubular member for refrigerant flow, and said third tubular member also having a top end extending through said first aperture in said first tubular member;

a fourth tubular member concentrically disposed within said third tubular member and extending through said second aperture in said second tubular member, said fourth tubular member having an open bottom end located between the closed bottom end of said second tubular member and the closed bottom end of said first tubular member which connects said first tubular member with said fourth tubular member for refrigerant flow;

a helical baffle plate coiled around second tubular member for restricting refrigerant flow in the annular space between said first and second tubular members;

a plurality of annular fins secured around said first tubular member in a spaced-apart relationship, each of said annular fins having opposed top and bottom surfaces and a central opening, sized to snugly receive said first tubular member, connecting said top and bottom surfaces, and the top surface of each of said annular fins being sloped downwardly from said central opening;

a plurality of longitudinal fins concentrically positioned around said first tubular member and engaged with the top and bottom sand bottom surfaces of said annular fins so as to divide such into a plurality of laterally segregated segments, each of said longitudinal fins having an inner edge secured against said first tubular member along one of the junctions between said planar side walls and an outer edge spaced outwardly from the outer peripheral edge of each of said annular fins relative to said first tubular member; and means for delivering a freezable liquid onto said first tubular member and said annular and longitudinal fins.

17. The evaporator according to claim 16 wherein said helical baffle plate comprises a strip of heat conductive material having an outer edge contacting said first tubular member and an opposed inner edge contacting said second tubular member whereby heat is transferred through said strip from said first tubular member to said second tubular member.

18. The evaporator according to claim 17 wherein said strip of heat conductive material has a top end located adjacent the open top end of said second tubular member and a bottom end located adjacent the closed bottom end of said second tubular member.

* * * * *